United States Patent [19]

Eddy

[11] Patent Number: 5,046,744

[45] Date of Patent: Sep. 10, 1991

[54] HUNTING POINT FOR ARROWS

[76] Inventor: Byron C. Eddy, 10441 Calle Trece, Tucson, Ariz. 85748

[21] Appl. No.: 565,931

[22] Filed: Aug. 13, 1990

[51] Int. Cl.[5] ..... F42B 6/08

[52] U.S. Cl. ..... 273/421

[58] Field of Search ..... 273/421, 422

[56] References Cited

U.S. PATENT DOCUMENTS

| | | | |
|---|---|---|---|
| 2,568,417 | 9/1951 | Steinbacher | 273/421 |
| 2,820,634 | 1/1958 | Vance | 273/421 |
| 3,014,305 | 12/1961 | Yurchich | 273/419 |
| 3,168,313 | 2/1965 | Lint | 273/419 |
| 3,578,328 | 5/1971 | Rickey | 273/421 |
| 3,600,835 | 8/1971 | Hendricks | 273/421 |
| 3,738,657 | 6/1973 | Cox | 273/421 |
| 4,166,619 | 9/1979 | Bergmann | 273/421 |
| 4,615,529 | 10/1986 | Vocal | 273/421 |

*Primary Examiner*—Paul E. Shapiro

*Attorney, Agent, or Firm*—J. Michael McClanahan

[57] ABSTRACT

A hunting point for attachment to arrows used in bow hunting having two thin flat metal blades juxtaposed each other held together by a rearwardly located tubular body, each blade having a sharpened projection first end adapted to precede the arrow in flight for initial penetration of the game animal hide. Upon penetration into the game animal, the hunting point goes through a metamorphosis wherein the front first sharpened end of each blade rotates to the point where it becomes the trailing end and the rear second end of the blade rotates to the front to become the forward leading point. By enabling such a metamorphosis, minimum resistance to the arrow in flight and to initial penetration of the animal's hide is achieved and maximum cutting area inside the animal is obtained after the initial penetration. To rotate the blades from a narrow sharpened entering point to a wide inverted "V" configuration, an outstanding barb located at the rear portion of each blade engages the hide of the animal to cause each blade to initiate rotation to its new maximum cutting position.

5 Claims, 1 Drawing Sheet

HUNTING POINT FOR ARROWS

BACKGROUND OF THE INVENTION

1. Field of the Invention

The field of the invention is arrowheads or points for arrows used in combination with a bow for hunting. More particularly, the field involved concerns points which assume one configuration during flight and a second configuration as it strikes the target, such as to more efficiently accomplish its function of humanely disabling and killing the game animal.

2. Description of the Related Art

In recent years there has been significant advances in the art of arrowheads or points for hunting arrows designed to more effectively disable and preferably kill the animal being hunted and while doing so, to reduce suffering by the animal and to cause the animal to cease its travel. In this respect, early advances combined the features of a penetrating arrowhead with the barb features of a fish hook wherein once an arrow penetrated an animal, retractable barbs attached to the arrowhead would mitigate against removal of the arrow and arrowhead, at least along the path by which the arrowhead entered. This is shown in U.S. patents to Yurchich U.S. Pat. No. 3,014,305) and Lint (U.S. Pat. No. 3,168,313). Both of these inventions show arrowheads with retractable barbs, the first having barbs projecting outward after impact and the second having the projecting barbs in place before impact.

Later inventions combine retractable sharpened barbs with a tubular pointed arrowhead or point such that upon impact of the arrowhead with the animal, the barb is released from its position along the tubular side of the point such as to cut a wide swath as the arrow penetrates into the body of the animal. This arrangement is shown in the U.S. patents to Hendricks (U.S. Pat. No. 3,600,835) and Cox (U.S. Pat. No. 3,738,657). In both these devices, the sharpened barbs are in a concealed position in the tubular body of the pointed arrowhead until the time that the arrowhead strikes the target whereupon a catch mechanism is released and the barb is swung outwardly by a resilient member, such as compressed rubber. By this device, the sharpened barb does not protrude from the arrow point during flight such as to affect the arrow's accuracy and possible injury to the hunter is reduced by holding the barb in the arrowhead body. In Cox, a plurality of sharpened barbs emerge from the tubular body and are constantly urged outward by elastic bands continually pulling the pivotal point of the sharpened barbs to the rear, such as to cause the barbs to spread outwardly.

Further improvements in hunting arrowheads or points are shown in the patent to Burgmann (U.S. Pat. No. 4,166,619) wherein a pair of sharpened blades or barbs are pivotally contained in the body of the arrow shaft with a catch mechanism located at the rear of the blades, the catch so oriented that after the arrow point has entered the body of an animal, the catch mechanism is engaged which causes the blades to pivot outwardly and engage the interior portions of the animal. The blades rotate to a fixed position for positive securing. In addition, Burgmann provides an air passageway through the hunting point and arrow shaft to aid in pulmonary collapse to hasten death of the animal.

Lastly, Vocal in U.S. Pat. No. 4,615,529 provides an arrow point and shaft wherein pivotal blades are attached to the rear portion of a triangularly shaped sharpened point, the pair of pivotal blades also pivoting to an outstanding position after the point has entered the body of the animal. In addition, the arrow shaft itself is sectional as well as tubular, and has a cord passing through it which aids in the retrieval after the arrow has lodged.

All of the above prior art patents are characterized by arrow point bodies which have protruding barbs or cutting blades extending outwardly from its sides, some extending prior to the arrow point entering the body of the animal and some extending immediately after the arrow point has entered the body of the animal. While the extending blades or barbs accomplish their function very efficiently, i.e., that of cutting as wide a swath as possible in order to bring the game down as soon as possible, yet the tubular body of the arrow point itself, in most cases, provides little help, it only seeming to serve as the body for supporting the outgoing blades.

All of the arrowheads or points illustrated above employ a tubular pointed arrowhead body (with the exception of Vocal) with the barbs or blades emerging from the body, either being pivotal near the head of the body or at the rear of the body, some pivoting upon entering the body of the animal and some pivoting after entry into the body of the animal. This, of course, is not without reasons since for the arrow to travel through to its target with minimum air resistance, it is generally necessary that the smallest point cross section as possible be utilized. Accordingly, there is good reason for the design of the arrow points heretofore. However, the prior art arrowheads or points suffer from the shortcoming that little effect is done by the tubular pointed body portion of the arrow point itself, substantially all the effect being done by the outstanding barbs or blades. It is to this relative inefficiency of the tubular pointed body portion of the arrowhead or point that the inventor directs his invention.

It is thus readily apparent that the efficiency of an arrowhead or point may well be improved if the whole point itself comprises the outgoing blades which perform much more efficiently than the narrow, tubular body point.

It is also apparent that an obvious improvement to the state of the art exists if the rather small point on the arrow shaft necessary for guiding the arrow to its mark should, upon striking the animal, metamorphosis entirely into outstanding blades which bring down the game more efficiently.

SUMMARY OF THE INVENTION

The embodiment of the invention described consists of two blades pivotally mounted to a rearward located tubular body, the tubular body adapted to be attached to one end of an arrow shaft. More specifically, the two blades which are identical in construction, are so constructed as to form a very narrow sharp first forward penetrating portion of the hunting point (without the tubular body initially touching the game), and as the hunting point enters the body of the animal, outstanding barbs attached to the blades and situated rearward of the forward section of the blades are engaged by the animal hide to cause the blades to pivotally separate where the blades themselves form an inverted "V" configuration. At that time, the hunting point has gone through a complete metamorphosis from a sharpened narrow hunting point for initial penetration to a very broad hunting point that relies entirely upon the extended blades for cutting while penetrating. The tubular body is never the predecessor of the blades.

Each blade is an elongated thin piece of sharpened metal having at a first end a sharpened end or projection, one side making up the projection at the first end taking a long slightly curving cutting edge to the opposite or second end where it terminates into a right angle foot. Along the other side making up the first end is a substantially straight cutting edge (except for very near the first end projection) which terminates into an outwardly protruding barb, which also has a cutting edge. Situated between the right angle foot at the second end and the barb is a pivot hole about which the sharpened blade rotates. The barb is adapted to catch onto the hide of the animal to start pivoting the blades apart from their in-flight and initial penetration configuration. Once the blades start pivoting, further penetration in the animal itself will cause the blades to continue to rotate.

Substantially all edges of the blade are sharpened by grinding off the metal at an angle near the edge along one flat side of the blade. The only portion of the blade not having a sharpened edge along the sides is that portion that is never in a forward looking position while the hunting point is in flight or penetrating the game, namely the rear area near the pivot hole. A portion of this unsharpened part of the hunting point comprises a pair of stops on opposite sides of the pivot hole, the stop coming to rest against the tubular body to limit rotation of the blade in each rotational direction.

The first and the second blade are pivotally mounted in a slot formed transversely across the front end of the tubular body, a pivot pin passing across this slot and passing through the pivot hole of each of the blades. The pin is frictionally held in holes formed in the tubular body to secure it there. The blades are held in the slot of the tubular body in an overlapping configuration such that their sharpened edges are on opposite sides from each other, i.e., the completely flat side of each blade are touching each other. In position in the slot of the tubular body, the blades are held against each other and secured by friction in order that their normal storage position and position during flight of the arrow is such that both sharpened ends or projections of both blades are together and aligned to point in the direction of the longitudinal axis of the arrow shaft. Sufficient friction is created between the two blades themselves and between the tubular body slot to hold them in that position during storage and during flight, but not so much friction such that the hide of the game animal pulling on the protruding barbs would not be able to pivot the blades apart. The forward end of the tubular body surrounding the slot is conically shaped.

As the subject hunting point blades rotate from their initial penetration position to their final resting and maximum cutting position caused initially by their barbs engaging the animal's hide, each right angle foot at the lower end of each sharpened blade rotates to become the new leading edge of the hunting point and this right angle (which is also sharpened) then becomes the forward most point of the arrow. Both right angle feet on the sharpened blades now constitute the new end of the now configured inverted "V" hunting point. The tubular body is still rearward of this new end and follows the blades at all times.

Lastly, at the rear end of the tubular body opposite the slot is a threaded shaft. This shaft is adapted to screw into the threaded female opening at the front end of the arrow shaft.

To withdraw the hunting arrow from the game animal, the hunter grasps the arrow shaft and pulls outwardly. This causes the sharpened blades to rotate back to their initial flight position and presents minimum obstruction to the withdrawal of the arrow shaft and its hunting point.

Accordingly, it is an object of the subject invention to provide a hunting point which presents a sharpened end or projection designed to penetrate the hide of a game animal but which, upon travel through the game, expands to provide maximum cutting edges to kill the animal in the most humane way possible.

It is another object of the subject invention to provide a hunting point which is most efficient and provides that the blades making up the hunting point metamorphosise from a sharpened narrow point to a broad cutting inverted "V" formation.

It is still a further object of the subject invention to provide a hunting point without a forward tubular body leading the arrow into the game animal.

Other objects of the invention will in part be obvious and will in part appear hereinafter. The invention accordingly comprises the apparatus possessing the construction, combination of elements, and arrangement of parts which are exemplified in the following detailed disclosure and the scope of the application which will be indicated in the claims.

BRIEF DESCRIPTION OF THE DRAWINGS

For further understanding of the features and objects of the subject invention, reference should be had to the following detailed description taken in connection with the accompanying drawings wherein.

In various views like index numbers refer to like elements.

DETAILED DESCRIPTION OF THE PREFERRED EMBODIMENT

Figure 1:
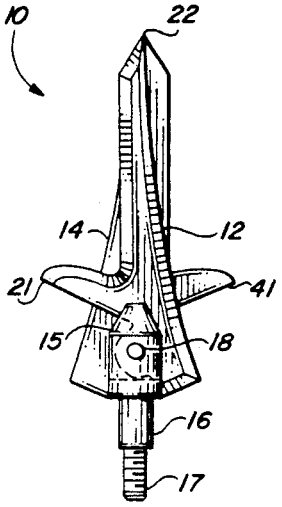
FIG. 1. is a top view of the subject hunting point in a stored or in-flight configuration.

Referring now to FIG. 1, a top view of the subject inventive hunting point is shown apart from an arrow shaft. Firstly, hunting point 10 is made up of the two elongated flat metal blades, namely first blade 12 and second blade 14, the blades so oriented that they lay or juxtaposed one upon another with the back sides of the blades frictionally engaging each other such that hunting point 10 maintains the position shown in FIG. 1. during storage, during the flight with the connecting arrow, and during initial penetration of the game animal. The pivotal or rotational travel of each blade a common pivotal point (in each rotational direction) is limited by a pair of stops engaging the round sides of the solid cylindrical tubular body 16, both first and second blades 12 and 14 respectively shown in FIG. 1 residing at the first of their respective stops as will be more clearly shown in later figures.

As can be seen in FIG. 1, elongated first blade 12, whose front or top face is shown, comprises a thin flat piece of high quality steel, generally having a thickness of about 0.050 inch, an overall length of approximately 2½ inches, and width of approximately 1 inch (including the protruding barb), the peripheral edge (less only a small portion) ground off on the front or top flat face to form a sharpened edge, preferably razor sharp. Second blade 14 is an exact same copy of first blade 12, rotated so only the back or rear flat face is seen in FIG. 1. Along this back face there is no ground-off edge as there is on the front face of the blade, however, it is realized, that the back face could also have a ground-off edge so that the sharpened edge formed is made up of two sharpened edges coming from both flat surfaces rather than one as detailed in the preferred embodiment.

Both first and second blade pivot around pivot pin 18 by the means of pivot holes formed in each of the blades. Pivot pin 18 passes from side to side through a longitudinal slot formed in the front end in tubular body 16 with both blades residing within this slot. It is against the rounded sides of tubular body 16 that the first stop portion of each blade rests to hold the blades in the storage, in-flight, and initial penetration position shown in FIG. 1. In the preferred embodiment, the first stop of each of the blades abutting the sides of tubular body 16 place the sharpened first end or projection of both blades overlapping one another so that the hunting point, when looking down upon the sharpened ends, substantially appears as one piece of metal having a single front point.

At the rear end of tubular body 16 opposite the slot is threaded shaft 17 adapted to receive the female threads of an insert placed in the end of the arrow shaft to which hunting point 10 attaches. At the front end of tubular body 16 opposite the threaded shaft 17 is the cone shaped front portion 15 (surrounding the slot) which is so shaped as to minimize the affect of that portion of hunting point 10 entering the game animal as well as to present minimum air resistance to the flight of the arrow. With the shape of the hunting point shown, the hunter's shooting accuracy using the point is improved due to enhanced flight characteristics in that with the reduced broadside size of the hunting point, minimum wind planing is experienced. Wind planing is the tendency of the point to steer the arrow from the front rather than the feathers at the rear. In addition, there also is efficient initial penetration into the body of the animal wherein, unlike a sharpened shaft point, the invention's sharpened ends cut instead of punch into the animal.

Figure 2:
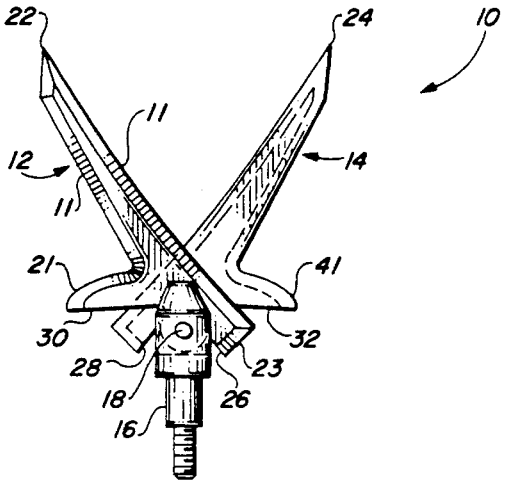
FIG. 2. is a top view of the subject hunting point in a configuration immediately after entering the game animal where the blades have just started to separate by rotating.

FIG. 2 shows the invention in a top view where the blades have begun to spread apart after hunting point 10 has substantially penetrated the animal, the blades initially being pulled apart by barbs 21 and 41 engaging the animal's hide and the resistance of the animal's toughened hide to the barb's passage. This resistance of the passage of the barbs through the hide causes the blades to begin their rotation around pivot pin 18 and to achieve the intermediate position shown in FIG. 2. Once the blades reach the position shown in FIG. 2, they will continue to rotate to the full inverted "V" formation shown in FIG. 3 as they encounter the animal's interior body.

Shown in FIG. 2 is first blade 12 with its sharpened edge 11 that circumscribes almost the total periphery of the blade. Shown also is second blade 14, however, it is noted that the sharpened edge on second blade 14 is shown dotted as it is on the underside face of blade 14. What is seen in FIG. 2 is the back face of the blade having the flat bottom with no sharpened or ground off edge. Also shown is the sharpened first end projections 22 and 24 of first blade 12 and second blade 14 respectively. Seen leaving their initial position against the rounded sides of tubular body 16 are the blades first stops, namely first stop 26 on blade 12 and first stop 28 on blade 14. Each first stop of each blade had originally engaged the rounded side of tubular body 16 to stop the rotational motion of the blades (in one rotational direction), and fix the position of the blades. As will be seen in FIG. 3, the first stops will soon be next to the newly formed front cutting edge of the inverted "V" hunting point after it has completed its metamorphosis.

Figure 3:
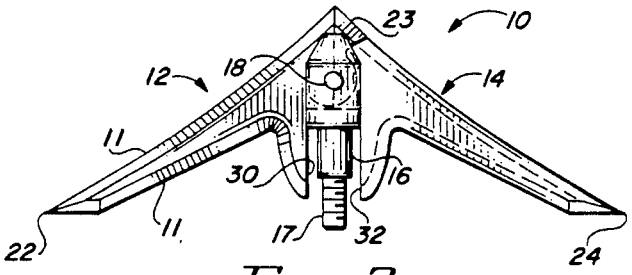
FIG. 3. is a top view of the subject hunting point in its final inverted "V" configuration internally to the game animal.

Second stops 30 and 32 of blades 12 and 14 respectively shown in FIG. 1. will rotate until they also strike the circular sides of tubular body 16 and stop the blades rotational travel (FIG. 3). Second stops 30 and 32 comprise the back edge of barbs 21 and 41 respectively.

Referring now to FIG. 3, inventive hunting point 10 is shown in its final penetrating position, that of an inverted "V" formation, wherin the first and second blades which initially made up the front or first sharpened end of the hunting point with sharpened projections 22 and 24 have now rotated around such that the right angle foot which was at the lower or second end of each blade have now come together to form a new single sharpened forward most point. At this time, the hunting point is completely buried within the game animal and it is still moving forward. At no time during the flight of the arrow or the initial penetration of the hunting point into the game animal has the relatively inefficient tubular body been the leading mechanism of the hunting point. In the configurations shown in FIGS. 1–3, the tubular body has always been rearward of the blades, never a first penetrating element. However, because the tubular body will at some time engage the game animal, the forward or front portions of the body are conical in shape at its place recessed behind the sharpened cutting edges of each blade.

More specifically, shown in FIG. 3 are first and second blades 12 and 14 respectively, with sharpened edge 11 encompassing the majority of the periphery of first blade 12. Right angle foot 23 located at the second end of blade 12 has now become the forward most point of hunting point 10. On the opposite side of hunting point 10 is second blade 14 having the outline of its sharpened edge shown in dotted lines with sharpened first end 24 now having rotated around from the initial forward position to its final position with its right angle foot at the rear or second end most forward. Shown on both first and second blades are their respective second stops 30 and 32, each blade having rotated to the position where each second stop now engages respective opposite sides of the circular surface of tubular body 16.

The configuration of the invention shown in FIG. 3 is achieved very soon upon entry into the game animal's body such that maximum cutting is soon reached in order that the animal is brought to a quick and humane death. It is noted that with the blades shown in the position shown in FIG. 3, the corner of right angle foot 23 of blade 12 aligns with the corner of the right angle foot of blade 14 which is immediately adjacent and touching. Lastly shown in FIG. 3 is the threaded shaft 17 upon which the arrow shaft itself fastens.

Figure 6:
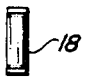
FIG. 6. is a side view of the pivot pin which pivotally secures the sharpened blades within the tubular body.
Figure 4:
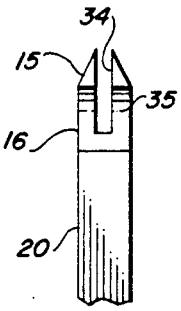
FIG. 4. is a side view of the tubular body of the invention.
Figure 5A:
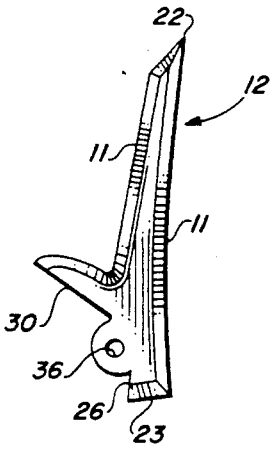
FIGS. 5.*a*. and 5.*b*. are top views of each of the sharpened blades which make up the invention.
Figure 5B:
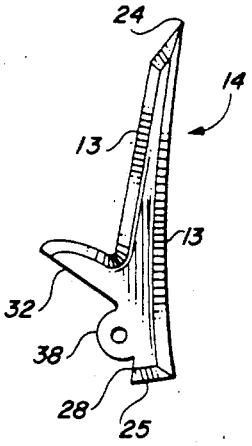

Shown in FIGS. 4–6 are the various elements which make up hunting point 10 and as can be seen, are few in number and simple in construction. Firstly, FIG. 4 is a side view of tubular body 16 showing it to comprise an essentially circular rod which has been attached to an arrow shaft. At the top or front end of tubular body 16 has been formed the cone shaped front portion. Both the cone shaped front portion and the major portion of the largest diameter portion of the rod is intersected by slot 34 within which both first and second blades reside. Pin hole 35 has been formed at right angles to the sides of slot 34 and in which is fixedly set pivot pin 18 (FIGS. 1–3 and 6). Immediately below the larger rounded portion of tubular body 16 is a stepped down smaller shaft, the smaller shaft eventually terminating in threaded shaft 17 (FIGS. 1–3). Threaded over the threaded shaft 17 as seen in FIGS. 1–3 is arrow shaft 20, the object for which hunting point 10 was invented.

Referring now to FIGS. 5.*a*. and 5.*b*., top views are seen of both elongated first blade 12 and second blade 14. As seen in these two figures, the blades are constructed identical to each other for ease of manufacturing, to reduce costs, and to facilitate assembly, since the chance of getting the blades mixed up during assembly is eliminated. Each blade, as mentioned in the preferred embodiment, is a thin sheet of high quality steel adapted to receive and to maintain a sharpened edge. Shown on first blade 12 is sharpened edge 11 circumscribing a substantial majority of the peripheral edge of the blade, excepting only first stop 26 and second stop 30 together with the circular arc surrounding pivot hole opening 36. At the first end of blade 12 is sharpened projection 22 and at the opposite second end, right angle foot 23. The only feature shown in FIG. 5.*a*. that has not been shown in previous figures is pivot hole 36 formed in the first blade 12. Pivot hole 36 receives pivot pin 18 as blade 12 resides in slot 34 of tubular body 16. Pivot hole 36 resides just interiorly from the blade periphery between first stop 26 and second stop 30.

With regard to blade 12, starting at the sharpened first end, along the longest of the two elongated sides making up the sharpened projection 22 is a first slightly arcuate side which is ground off to a sharpened edge, this arcuate side terminated at the rear or second end with a foot formed at an approximate right angle. Then, along the other side of the elongated sides making up the sharpened first end, is an elongated substantially straight second side (except for just at projection 22), retreating to a protruding barb situated at a slightly acute angle to the direction of the elongation of the blade, the second side of the blade along the elongated side and the barb also being ground off to a sharpened edge. Continuing, the barb falls off with second stop 30, the circular arc surrounding the pivot hole 36, and finally first stop 26 joining to the right angle foot 23.

FIG. 5.*b*. shows second blade 14 turned over from its position shown in FIGS. 1–3 in order that the sharpened edge 13 may be seen. As each blade is identical, sharpened edge 13 of blade 14 is an exact duplicate of sharpened edge 11 of blade 12. Accordingly, sharpened projection 24 is at the first end of second blade 14 with right angle foot 25 at the opposite or second end. Also shown are first stop 28 and second stop 32 which function identical with the same named stops of the first blade. Lastly shown is pivot hole 38, similar to pivot hole 36, surrounded by its arc shaped border.

Both first and second blades 12 and 14 respectively are tightly fit within slot 34 of tubular body 16 so that they press against each other to resist rotation until force is applied to the blades.

Lastly, FIG. 6 shows a side view of pivot pin 18 comprising an elongated rounded pin adapted to be secured in pin hole 35 of tubular body 16 bridging slot 34. Pivot pin 18 passes through the pivot holes 36 and 38 of the first blade 12 and second blade 14 respectively. Pivot pin 18 is so sized that a tight frictional fit between it and pin holes 35 in tubular body 16 is achieved.

While a preferred embodiment of the invention has been shown and described, it is appreciated that other such embodiments of the invention are possible and that there is no intent to limit the invention by such disclosure, but rather it is intended to cover all modifications and alternate embodiments falling within the spirit and the scope of the invention as defined in the appended claims.

I claim:

1. A hunting point for attachment to an arrow used in bow hunting which metamorphoses from a flight sharpened end to a sharpened wide "V" after penetration of a game animal's hide and for continued movement through the animal, said hunting point comprising:

a body adapted to be attached to the arrow;

an elongated first blade having a first end and a second end, said first end terminating in a sharpened point, and a spaced apart first side and a second side each having a length running from said first end to said second end, said second side having an outstanding barb with a forward portion and a rearward portion, said first side having a sharpened edge from said first end to said second end and said second side having a sharpened edge from said first end to and including said barb forward portion, said first and second side edge being substantially parallel to each other from a first location adjacent said barb to a second location near but behind said point, said second side edge being angled towards said first side edge from said second location and extending to meet said first side edge at said point, said first blade pivotally attached to said body proximate said second end;

an elongated second blade having a first end and a second end, said first end terminating in a sharpened point, and a spaced apart first side and a second side each having a length running from said first end to said second end, said second side having an outstanding barb with a forward portion and a rearward portion, said first side having a sharpened edge from said first end to said second end and said second side having a sharpened edge from said first end to and including said barb forward portion, said first and second side edge being substantially parallel to each other from a first location adjacent said barb to a second location near but behind said point, said second side edge being angled towards said first side edge from said second location and extending to meet said first side edge at said point, said second blade pivotally attached to said body proximate said second end, said first blade and said second blade being in pivotable relationship to each other;

said first and second blade being pivotal to and extending forward of said body; and said first end of both said first blade and said second blade overlapping to lead in flight and remaining overlapped in penetration of the game animal's hide and movement through the animal, said angled side edge portions serving to maintain said first and second blade in a closed position during initial penetration, both said first and second blade first and second side sharpened edge engaging the animal's hide and penetrating the animal along their length to a depth until said barb forward portion of both said first blade and said second blade engages the animal's hide to cause both said first and second blade to pivot said second end of both said first blade and second blade to become the leading members of the sharpened wide "V" configuration.

2. The hunting point as defined in claim 1 wherein both said elongated first and second blade second end terminates in a right angle foot, said right angle foot of both said first blade and second blade overlapping to become the leading sharpened point in further movement through the game animal, both said first blade and second blade first side sharpened edge forming the wide "V".

3. The hunting point as defined in claim 2 further including a first stop formed in both said first blade and second blade second side proximate said second end, said first stop engaging said body when said first blade and said second blade first end overlaps.

4. The hunting point as defined in claim 3 further including a second stop formed in both said first blade and second blade second side proximate said barb rearward portion, said second stop engaging said body to retain said first blade and said second blade in the sharpened wide "V" configuration.

5. The hunting point as defined in claim 4 wherein said body defines a cylindrical body which includes a slot and a pivot pin, said pivot pin transverse to and crossing said slot, both said first blade and said second blade partially residing in said slot and pivoting about said pivot pin.

* * * * *